US008426754B2

(12) United States Patent
Kikuchi et al.

(10) Patent No.: US 8,426,754 B2
(45) Date of Patent: Apr. 23, 2013

(54) ELECTRICAL CONTACT FOR VACUUM VALVE

(75) Inventors: Shigeru Kikuchi, Hitachi (JP); Satoru Kajiwara, Hitachi (JP); Masato Kobayashi, Hitachi (JP); Misuk Yamazaki, Kashiwa (JP)

(73) Assignee: Hitachi, Ltd., Tokyo (JP)

( * ) Notice: Subject to any disclaimer, the term of this patent is extended or adjusted under 35 U.S.C. 154(b) by 1075 days.

(21) Appl. No.: 12/354,252

(22) Filed: Jan. 15, 2009

(65) Prior Publication Data

US 2009/0184274 A1 Jul. 23, 2009

(30) Foreign Application Priority Data

Jan. 21, 2008 (JP) ..... 2008-009969

(51) Int. Cl.
*H01H 1/02* (2006.01)

(52) U.S. Cl.
USPC ..... 200/269

(58) Field of Classification Search ..... 218/123, 218/127, 128, 130; 200/269
See application file for complete search history.

(56) References Cited

U.S. PATENT DOCUMENTS

| | | | | |
|---|---|---|---|---|
| 6,248,969 | B1 * | 6/2001 | Komuro et al. | 218/118 |
| 2005/0153534 | A1 | 7/2005 | Kikuchi et al. | |
| 2008/0163476 | A1 | 7/2008 | Gentsch et al. | |

FOREIGN PATENT DOCUMENTS

| | | | |
|---|---|---|---|
| EP | 0 634 766 | A2 | 1/1995 |
| EP | 1 249 848 | A2 | 10/2002 |
| JP | 2874522 | | 1/1999 |
| JP | 2002-313196 | | 10/2002 |
| JP | 2005-135778 | | 5/2005 |
| JP | 2005-197098 | | 7/2005 |
| JP | 2006-140073 | | 6/2006 |
| JP | 3825275 | | 7/2006 |
| WO | 2006/079495 | A1 | 8/2006 |

* cited by examiner

*Primary Examiner* — Vanessa Girardi
(74) *Attorney, Agent, or Firm* — Mattingly & Malur, PC

(57) ABSTRACT

An electrical contact comprising a contact layer for making a contact with an opposite electrical contact and a high conductive layer in an opposite side of the contact layer, the layers being integrally connected to each other, wherein the contact layer contains Cr, Cu and Te, and the high conductive layer contains copper as a main component, and wherein the high conductive layer is provided with a means for suppressing warp of the contact layer at the time of turning on of the contacts.

20 Claims, 8 Drawing Sheets

ELECTRICAL CONTACT FOR VACUUM VALVE

CLAIM OF PRIORITY

The present application claims priority from Japanese patent application serial No. 2008-9969, filed on Jan. 21, 2008, the content of which is hereby incorporated by reference into this application.

FIELD OF THE INVENTION

The present invention relates to a new electrical contact that is used for a vacuum circuit breaker, a vacuum switchgear, etc.

RELATED ART

Electrical current switches employing vacuum circuit breakers that use vacuum as an insulating medium have less influence on environment and substitution of gas insulated switchgears with the vacuum switchgears has been carried out. Enlarged capacity thereof has been desired. Electrical contacts for interrupting large current should have a high density in order to secure a large current flow capacity and a good thermal conductivity. Therefore, Cr—Cu series electrical contacts that are used for general vacuum circuit breakers have been manufactured by infiltration methods or sintering methods, which are capable of densifying the contacts.

For example, patent document No. 1 discloses electrical contacts in which Cu is melted and infiltrated into low density sintered body of Cr—Cu. Patent document No. 2 discloses high density electrical contacts which are produced by sintering high density molding of Cr—Cu in an inert gas atmosphere. Patent document No. 3 discloses electrical contacts in which flake shaped Cr powder particles are oriented in a specified direction and are sintered to produce high density sintered product. In this method, an amount of Cr can be reduced.

Patent document No. 1; Japanese Patent No. 2,874,522

Patent document No. 2; Japanese patent laid-open 2005-135778

Patent document No. 3; Japanese patent 3,825,275

SUMMARY OF THE INVENTION

Conventional electrical contacts of Cr—Cu produced by the infiltration method exhibit reduced conductivity and a high hardness due to solid solution of Cr into Cu phase in the contact layer. Therefore, an actual contact face area between the contacts becomes smaller than a designed value in current flow, which generates a large joule heat and increases a temperature at the contact points. This may lead to weld between the electrical contacts.

As a means for reducing electric resistance and suppress the joule heat, a layer whose main component is copper is formed on the face opposite to the contact face. Since this layer is formed integrally by the infiltration method, the conductivity decreases due to solid dissolution of Cr. Therefore, it is impossible to suppress the joule heat.

On the other hand, the electrical contacts produced by the sintering methods, there is no solid solution of Cr into the Cu matrix because there is no step of melting Cu.

However, since the entire sintering material is composed of the Cr—Cu composition in order to improve productivity and since the density of the product is smaller than that of infiltration method product, the suppression of joule heat was insufficient.

Accordingly, in the electrical contacts produced by the sintering method, if a layer made of Cu is formed on the face opposite to the contact face, it may be possible to suppress joule heat, but since the sintering shrinkage of the contact layer and the Cu layer is different, there may be curving after sintering.

If the curving or warp of the sintered bodies is removed by machining, temperature rise during the current flow generates the warp so that the contact area decreases to increase a contact resistance, which may cause the contacts to be welded by joule heat.

It is an object of the present invention to suppress warp deformation of an electrical contact at the time of sintering or turning on of electricity to thereby provide a suitable structure of electrical contacts having excellent heat and electrical conductivity.

The present invention provides an electrical contact comprising a contact layer for making a contact with an opposite electrical contact and a high conductive layer in an opposite side of the contact layer, the layers being integrally connected to each other, wherein the contact layer contains Cr, Cu and Te, and the high conductive layer contains copper as a main component, and wherein the high conductive layer is provided with a means for suppressing warp of the contact layer at the time of turning on of the contacts.

In the present invention the electrical contact mentioned above has the means for suppressing warp which includes at least one concentric groove, formed in the high conductive layer, with respect to the contact layer, at least one side face groove formed in the side face of the high conductive layer, an intermediate layer, sandwiched between the high conductive layer and the contact layer, having a composition intermediate between that of the contact layer and that of the high conductive layer, and a taper, formed in the rear face of the high conductive layer opposite to the contact layer, being inclined towards the periphery of the high conductive layer such that the periphery is thinner than the inner than the other.

The warp suppression means is used to mean that the high conductive layer is provided with the means to suppress the warp or bending that may take place in the contact layer or the contact during the current flows through the contacts. The warp suppression means includes a concentric groove formed in the high conductive layer around an electrode rod open to a face opposite to the contact. The means further includes a side face groove formed in the side face of the high conductive layer. The warp suppression means further includes an intermediate layer sandwiched between the high conductive layer and the contact layer. The intermediate has a composition intermediate of that of the high conductive layer (copper dominant layer) and the contact layer (Cr, Cu, Te and/or Mo, W and Nb). The warp suppression means further includes a tapered high conductive layer formed at the opposite side to the contact layer. The high conductive layer has a thickness that reduces in the direction towards the periphery thereof. The above measures are employed singly or in combination. Details of the structures and compositions, etc will be explained hereinafter.

An electrical contact according to one aspect of the present invention comprises a contact layer and a high conductive layer, the layers being integrally connected to each other, wherein the contact layer contains Cr, Cu and Te, and the high conductive layer contains copper as a main component, and wherein provided that a thickness of the contact layer is $t_1$, a thickness of the high conductive layer is $t_2$, and a diameter of the electric contact is D, $t_1$, $t_2$ and D satisfy the following requirements defined by (1) and (2), the high conductive layer having at least one groove concentric with the electrical contact in a face opposite to the contact face of the electrical contact.

$$0.15t_2 \leqq t_1 \leqq 1.27t_2 \quad (1)$$

$$2.94(t_1+t_2) \leqq D \leqq 5.55(t_1+t_2) \quad (2)$$

An electrical contact according to another aspect of the present invention comprises a contact layer, a high conductive layer, and an intermediate layer between the contact layer and the high conductive layer, the layers being integrally connected to each other, and the intermediate having an intermediate composition of the adjoining layers (the contact layer and the high conductive layer), wherein the contact layer contains Cr, Cu and Te, and the high conductive layer contains copper as a main component, and wherein provided that a thickness of the contact layer is $t_1$, a total thickness of the high conductive layer and the intermediate layer is $t_3$, and a diameter of the electric contact is D, $t_1$, $t_3$ and D satisfy the following requirements defined by (3) and (4).

$$0.15t_3 \leqq t_1 \leqq 0.80t_3 \quad (3)$$

$$2.94(t_1+t_3) \leqq D \leqq 8.10(t_1+t_3) \quad (4)$$

The high conductive layer and the intermediate layer of the electrical contact according to the present invention has at least one groove in a concentric circle with the electrical contact in a face of the high conductive layer opposite to the contact face of the electrical contact.

In the electrical contact according to the present invention, provided that a width of the groove is $w_1$, a depth is $d_1$ and a diameter is $w_1$, D, $D_1$, $d_1$ and $t_3$ satisfy the following conditions defined by (5), (6) and (7).

$$0.015D \leqq w_1 \leqq 0.045D \quad (5)$$

$$0.08t_3 \leqq d_1 \leqq 0.95t_3 \quad (6)$$

$$0.35D \leqq D_1 \leqq 0.85D \quad (7)$$

In the electrical contact according to the present invention, the high conductive layer or the intermediate layer has a side groove on a side periphery thereof, provided that a width of the side groove is $w_2$, a depth is $d_2$, and a distance between a face opposite to the contact face and the side groove is h, D, $d_2$, $t_3$, $w_2$ and h satisfy the following conditions defined by (8), (9), (10).

$$0.025t_3 \leqq w_2 \leqq 0.5t_3 \quad (8)$$

$$0.003D \leqq d_2 \leqq 0.085D \quad (9)$$

$$0.1t_3 \leqq h \leqq 0.9t_3 \quad (10)$$

In the electrical contact according to the present invention, the high conductive layer has a tapered shape whose thickness decreases towards the periphery thereof, an inclination of the tapered shape preferably being ½ to 1/30.

In the electrical contact according to the present invention, the electrical contact consists essentially of 15 to 30 wt % of Cr, 0.01 to 0.2 wt % of Te, the balance being Cu. The contact layer may additionally contain at least one member selected from the group consisting of Mo, W and Nb in 30 wt % or less in total amount of Cr and the member.

In the electrical contact according to the present invention, the contact layer has a center hole formed at the center of the disc, a plurality of slits formed from the center towards the periphery of the disc, the slits being not in contact with the center hole, whereby the disc is shaped into wing forms.

In the electrical contact according to the present invention, an amount of solid solution of Cr in the Cu constituting the high conductive layer is preferably 10 ppm or less.

A method of manufacturing the electrical contact of the present invention comprises: press-molding layers of mixed powder comprising ingredients for constituting a contact layer, mixed powder comprising ingredients for constituting an intermediate layer and copper powder for constituting a high conductive layer in layers; and sintering the layers at a temperature lower than the melting point of Cu in a reducing atmosphere or in an inert gas atmosphere.

The electrodes using the electrical contacts of the present invention are constituted by bonding high conductive layer of the electrical contacts of a disc form to electrode rods.

A vacuum valve of the present invention comprises at least a pair of a fixed electrode and a movable electrode disposed in a vacuum chamber wherein at least one of the fixed electrode and movable electrode is provided with the electrical contacts mentioned above.

A vacuum circuit breaker according to the present invention breaker comprises the above mentioned vacuum valve, the vacuum valve being provided with at least of a pair comprising the fixed electrode and the movable electrode being connected to conductor terminals extending outside of the vacuum chamber, and an operating mechanism for driving the movable electrode.

A vacuum switchgear according to the present invention comprises a plurality of vacuum valves each having a pair of fixed electrode and movable electrode, wherein the vacuum valves are electrically connected in series to each other by means of conductors and an operating mechanism for operating the movable electrode, each of vacuum valves being the one mentioned above.

According to the present invention, it is possible to provide electrical contacts having at least two layers with excellent heat and electrical conductivity, avoiding warp at the time of sintering and the current flow.

Figure 1A:
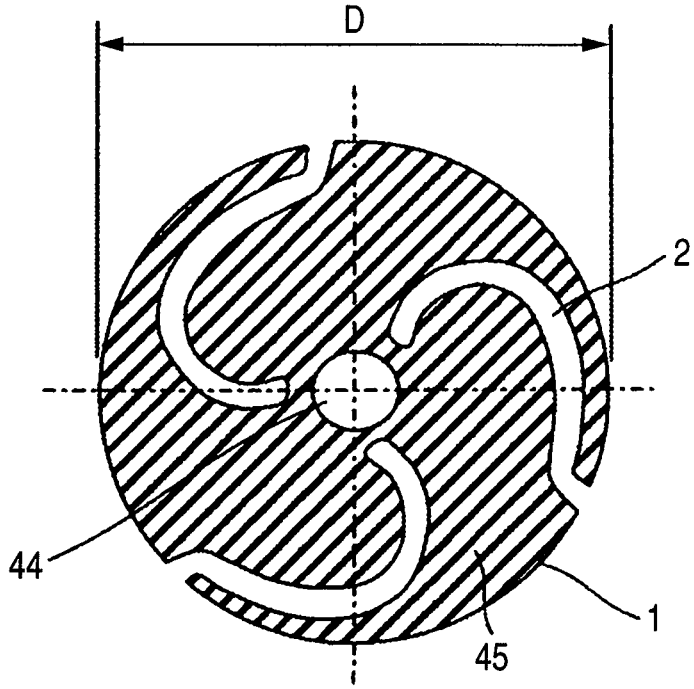
FIG. 1A shows a top plan view of a first example of an electrode having an electrical contact of the present invention.

Reference numerals used in the figures are:

1 denotes an electrical contact, 1*a* fixed side electrical contact, 1*b* movable side electrical contact, 2 a slit, 3, 3*a*, 3*b* a stain prevention plate, 5 a solder material, 6*a* a fixed electrode, 6*b* a movable electrode, 7 a shield, 8 a movable side shield, 9*a* a fixed side end plate, 9*b* a movable side end plate, 10 a bellows, 11 a guide, 12 a movable side holder, 13 an insulating cylinder, 14 a vacuum valve, 15 an epoxy resin cylinder, 16 an insulating operation rod, 17 an upper terminal, 18 a collector, 19 a lower terminal, 20 a contact spring, 21 a supporting lever, 22 a prop, 23 a plunger, 24 a knocking rod, 25 a roller, 26 a main lever, 27 trip coil, 28 trip lever, 29 reset spring, 30 a closing coil, 31 an evacuate cylinder, 32 an outer vacuum chamber, 33 an upper plate, 34 a lower plate, 35 a side plate, 36 an upper through hole, 37 an upper base, 38 an outer bellows, 39 a lower through hole, 40 an insulating bushing, 41 a lower base, 42 a flexible conductor, 43 a through hole for the flexible conductor, 44 a center hole, 45 a contact layer, 46 a high conductive layer, 47 a concentric groove, 48 an intermediate layer, 49 a side groove, and 50 a taper.

DETAILED DESCRIPTION OF THE PREFERRED EMBODIMENTS

The electrical contact of this example has a disc form and has two layers in a thickness direction thereof. A contact layer of the two layers consists of Cr, Cu and Te, and the layer to be connected to a conductor, a high conductive layer, contains Cu as a main ingredient. As the contact layer is made of a Cr and Cu alloy, the electrical contact exhibits excellent interruption performance and voltage withstanding property so that the characteristics required for electrical contacts are satisfied.

On the other hand, by providing the high conductive layer on the side opposite to the contact layer, heat and electrical conductivity of the whole electrical contacts are improved thereby to suppress generation of joule heat at the time of the current flow and improve anti-welding property.

When a thickness of the contact layer is $t_1$, a thickness of the high conductive layer is $t_2$ and a diameter of the electrical contact is D, the ranges of the values should satisfy the formulae (1) and (2).

As a result, it is possible to produce an electrical contact having no defects such as warp, layer separation, etc and having excellent heat and electrical conductivity enough to suppress joule heat.

In addition, the high conductive layer has at least one concentric groove in the face opposite to the contact face so that an expansion of the high conductive layer by joule heat is suppressed to prevent warp and/or layer separation.

The electrical contact according to this embodiment may have an intermediate layer whose composition is an intermediate of the contact layer and high conductive layer. The electrical contact may comprise three or more layers stacked in its thickness direction.

By forming the intermediate layer, a strain caused by difference in shrinkage of the contact layer and the high conductive layer at the time of sintering them may be alleviated to thereby prevent warp, layer separation, etc and to release thermal expansion difference to suppress an increase in contact resistance.

When the thickness of the contact layer is $t_1$, a total thickness of the high conductive layer and the intermediate layer is $t_3$, and a diameter of the electrical contact is D, $t_1$, and $t_3$ should satisfy the following relationships (3), (4).

Further, when the high conductive layer and the intermediate layer connecting to the high conductive layer have at least one concentric groove in the face opposite to the contact face, the elongation of the high conductive layer due to joule heat during the current flow can be suppressed to prevent warp or separation.

$$0.15t_3 \leqq t_1 \leqq 0.80t_3 \quad (3)$$

$$2.94(t_1+t_3) \leqq D < 8.10(t_1+t_3) \quad (4)$$

The electrical contact according to this embodiment should preferably have the groove formed in the face opposite to the contact face has a width of $w_1$, a depth of $d_1$, a diameter of $D_1$, a total thickness of the high conductive layer and the intermediate layer of $t_3$, and a diameter of the electrical contact of D, and the following relationships are satisfied to prevent warp and separation.

If the width $w_1$ and the depth $d_1$ are smaller than that defined by formula (5) or (6), suppression of elongation of the high conductive layer is not expected. If the above values are larger than that defined by formula (5) or (6), strength of the electrical contact decreases to bring about breakage of the electrical contact during operation of the vacuum switch.

Further, if the diameter $D_1$ is smaller than the value defined by formula (7), the concentric groove is formed at a position close to a bonding position between the electrical contact and an electrode rod, which is a conductive member. Accordingly, the electrical contact is easily deformed by impact at the time of switching operation. On the other hand, if the diameter $D_1$ is larger than the range defined by formula (7), the concentric groove is formed in the vicinity of the outer periphery so that suppression of elongation of the high conductive layer is insufficient.

$$0.015D \leqq w_1 \leqq 0.045D \quad (5)$$

$$0.08t_3 \leqq d_1 \leqq 0.95t_3 \quad (6)$$

$$0.35D \leqq D_1 \leqq 0.85D \quad (7)$$

In the electrical contact according to this embodiment, when a groove is formed in the outer periphery of the high conductive layer and the intermediate layer connecting to the high conductive layer, it is possible to suppress inner strain caused by difference in thermal expansion between the contact layer and the high conductive layer so that warp or separation is suppressed.

Provided that the side face groove has a width of $w_2$, a depth of $d_2$, a distance between the face opposite to the contact face and the groove is h, a total thickness of the high conductive layer and a thickness of the intermediate later is $t_3$ and a diameter of the electrical contact is D, the conditions defined by formulae (8) to (10) should be satisfied.

If the width $w_2$ and depth $d_2$ are smaller than those defined by formula (8) or (9), strain relief effect is insufficient, and if the values are larger than those defined by formula (8) or (9), strength of the electrical contact will decrease.

In addition, if the distance h between the face opposite to the contact face and the groove is smaller than the range defined by formula (10), strain relief effect is not expected, and if the difference is larger than the range defined by formula (10), separation of the contact layer and/or high conductive layer takes place.

$$0.025t_3 \leqq w_2 \leqq 0.5t_3 \quad (8)$$

$$0.003D \leqq d_2 \leqq 0.085D \quad (9)$$

$$0.1t_3 \leqq h \leqq 0.9t_3 \quad (10)$$

In the electrical contact according to this embodiment, the high conductive layer should preferably have a tapered shape at the face opposite to the contact face.

According to this structure, elongation of the high conductive layer decreases and warp at the time of turning on is suppressed. The angle of the tapered face is ½ to 1/30 in consideration of effect of warp suppression and productivity.

The contact layer consists essentially of 15 to 30 wt % of Cr, 0.01 to 0.2 wt % of Te, the balance being Cu, which may contain at least one of Mo, W and Nb in a total amount of 30 wt % including Cr.

The contact layer having this composition exhibits excellent interruption performance and voltage withstanding characteristics as well as electrical conductivity. If an amount of Cr is larger than the above, the electrical conductivity drastically decreases.

If an amount of Te is 0.01 to 0.2 wt %, strength of the Cr—Cu alloy decreases so that weld contacts are easily separated. If an amount of Te is less than the above, separation of weld contacts becomes difficult. If the amount is larger than the above, voltage withstanding property will decrease due to excess evaporation of Te.

If the contact layer contains at least one of Mo, W and Nb, of which hard particles are finely dispersed in the contact layer, welding is prevented and separation of welded contacts becomes easy.

In the electrical contact according to the embodiment, the contact layer should preferably have a center hole formed at the center of the disc, a plurality of slits formed from the center towards the periphery of the disc, the slits being not in contact with the center hole, whereby the disc is shaped into wing forms.

The center hole prevents arc generated at the time of current interruption from concentrating at the center of the electrical contact to thereby avoid interruption fault by arc staying. The slits grooves drive the arc towards the periphery to accelerate current interruption.

In the electrical contact according to the embodiment, an amount of solid solution of Cr in the Cu constituting the high conductive layer should preferably be 10 ppm or less. It is possible to keep the heat and electric conductivity of the high conductivity layer high to reduce joule heat at the time of turning on.

The electrical contact having the above mentioned advantages are manufactured by sintering method described in the following.

A method of manufacturing the electrical contact of the present invention comprises: press-molding layers of mixed powder comprising ingredients for constituting a contact layer, mixed powder comprising ingredients for constituting an intermediate layer and copper powder for constituting a high conductive layer in stacked layers; and sintering the layers. By press-molding powder materials each constituting each of the layers in an integrated form, layer separation at the time of sintering is avoided.

The sintering method makes hardness of the contact layer relatively low, and since there is no solid solution of Cr into Cu matrix, high conductivity of the contact layer is secured to reduce contact resistance with an opposed contact layer and suppress joule heat.

Since solid solution of Cr into the high conductive layer of Cu matrix, an amount of Cr can be limited to 10 ppm or less.

The sintering is carried out in a reducing atmosphere or in an inert gas atmosphere so that densification of the Cu matrix is accelerated to produce a sound sintered structure and to produce an electrical contact with excellent heat and electrical properties.

The electrical contacts according to the embodiment can be manufactured by infiltrating a low density molding of the mixed powder with molten Cu; however, the sintering method is capable of producing wing shaped electrical contacts with a final shape mold, which can produce the electrical contacts at a less expensive cost.

The electrode according to the present invention is produced by integrally bonding the electrode rod as the conductive member to the face of the high conductive layer of the electrical contact having a disc form. Therefore, the electrode has good conductivity and rapidly leads joule heat generated at the contact outside the vacuum valve.

The disc form electrical contact should preferably have the center hole and a wing form divided by slits each having a spiral form. The central hole can prevent concentration of arc generated at the time of current interruption in the center of the bonding point and prevent the arc from staying in the contact face. The slits assist the arc to move towards the periphery of the electrical contact to rapidly interrupt current.

The electrode using the electrical contact of the present invention can be provided with a cap shaped coil electrode at the high conductive layer side of the disc form electrical contact. The electrode rod is connected to the bottom of the cap electrode. As a result, the arc can be distinguished by magnetic field generated at the time of current interruption to obtain excellent interruption characteristics.

The vacuum valve according to the present invention is provided with at least a pair of a fixed electrode and a movable electrode at least one of which is the electrical contact according to the present invention.

The vacuum circuit breaker according to the present invention comprises a vacuum valve provided with at least a pair of a fixed electrode and a movable electrode at least one of which is the electrical contact of the present invention, conductor terminals connected to each of the electrodes and leading outside the vacuum valve, and an operating mechanism for driving the movable electrode.

The vacuum switchgear according to the present invention has a plurality of the vacuum valves of the present invention, the valves being electrically connected by means of conductors in series. As a result, the joule heat at the time of turning and welding of the contacts are suppressed. The present invention provides vacuum circuit breakers and various vacuum switches with excellent current characteristics and anti-welding property.

In the following the present invention will be explained by reference to the drawings. The scope of the present invention is not limited to the following examples.

EXAMPLES

Table 1 shows dimensions and compositions of electrical contacts of the present invention and comparative electrical contacts. Table 2 shows dimensions and methods of producing the electrical contacts of the present invention and comparative electrical contacts shown in Table 1. In the dimension ratio in Table 2, $t_3$ is high conductive layer thickness $t_2$ plus intermediate layer thickness.

Tables 3 and 4 show dimensions and compositions of electrical contacts of the present invention.

FIGS. 1A to 5B show various structures of the electrodes having the electrical contacts according to the present invention, wherein numeral number 1 denotes the electrical contact, 2 the spiral slit grooves for driving arc, 3 the stain prevention plate made of stainless steel for preventing a rear face of the contact from stain through the slit grooves, 4 the electrode rod, 5 a solder, 44 the central hole, 45 the contact layer, 46 the high conductive layer, 47 the concentric groove, 48 the intermediate layer, 49 the side face groove, and 50 the taper formed in the periphery of the high conductive layer.

TABLE 1

| | No. | Contact diameter D (mm) | Contact layer Composition (wt %) Cr | Cu | third component | Thickness $T_1$ (mm) | First intermediate layer Composition (wt %) Cr | Cu | third comp. | Thickness (mm) | Second intermediate layer Composition (wt %) Cr | Cu | Third component | Thickness (mm) | High conductive layer (Cu) Cr (ppm) | Thickness $t_2$ (mm) |
|---|---|---|---|---|---|---|---|---|---|---|---|---|---|---|---|---|
| Comparative | 1 | 50 | 30 | 67 | Nb; 3 | 3.5 | | | — | | | | — | | 7000 | 5.2 |
| | 2 | 50 | 25 | Bal | Te; 0.05 | 8.7 | | | — | | | | — | | | — |
| | 3 | 50 | 25 | Bal | Te; 0.05 | 3.5 | | | — | | | | — | | 4 | 5 |
| | 4 | 50 | 25 | Bal | Te; 0.05 | 8 | | | — | | | | — | | 4 | 10 |
| | 5 | 50 | 25 | Bal | Te; 0.05 | 1 | | | — | | | | — | | 3 | 10 |
| | 6 | 50 | 25 | Bal | Te; 0.05 | 10 | | | — | | | | — | | 4 | 4 |
| | 7 | 50 | 25 | Bal | Te; 0.05 | 10 | | | — | | | | — | | 4 | 7 |
| | 8 | 50 | 10 | Bal | Te; 0.05 | 5 | | | — | | | | — | | 3 | 7.5 |
| | 9 | 50 | 35 | Bal | Te; 0.05 | 5 | | | — | | | | — | | 3 | 7.5 |
| | 10 | 50 | 25 | Bal | Te; 0.05 | 5 | | | — | | | | — | | 3 | 7.5 |
| Inventive | 11 | 50 | 25 | Bal | Te; 0.05 | 4 | | | — | | | | — | | 4 | 5 |
| | 12 | 50 | 25 | Bal | Te; 0.05 | 3.5 | | | — | | | | — | | 3 | 9 |
| | 13 | 50 | 25 | Bal | Te; 0.05 | 7 | | | — | | | | — | | 3 | 10 |
| | 14 | 50 | 25 | Bal | Te; 0.05 | 1.5 | | | — | | | | — | | 3 | 10 |
| | 15 | 50 | 25 | Bal | Te; 0.05 | 5 | | | — | | | | — | | 3 | 7.5 |
| | 16 | 50 | 25 | Bal | Te; 0.05 | 7 | | | — | | | | — | | 3 | 5.5 |
| | 17 | 50 | 15 | Bal | Te; 0.05 | 5 | | | — | | | | — | | 3 | 7.5 |
| | 18 | 50 | 30 | Bal | Te; 0.05 | 5 | | | — | | | | — | | 4 | 7.5 |
| | 19 | 50 | 25 | Bal | Te; 0.05 | 3 | 10 | Bal | — | 4 | | | — | | 3 | 5.5 |
| | 20 | 50 | 25 | Bal | Te; 0.05 | 2 | 15 | Bal | — | 3 | 5 | Bal | — | 3 | 3 | 4.5 |
| | 21 | 50 | 25 | Bal | Nb; 3 | 5 | | | — | | | | — | | 3 | 7.5 |

TABLE 2

| | No. | Ratio of Dimension $t_1/t_2$ or $t_1/t_3$ | $D/t_1+t_2$ $D/t_1+t_3$ | Molding method | State after sintering or infiltration warp (mm) | Layer separation —; No, X; occurred | 25 kA interruption ○; could X; could not | Separation after 25 kA current flow ○; could X; could not | Remarks |
|---|---|---|---|---|---|---|---|---|---|
| Comparative | 1 | 0.67 | 5.75 | Each layer | 0 | — | ○ | X | Infiltration |
| | 2 | — | 5.75 | Each layer | 0.05 | — | X | X | Contact layer only |
| | 3 | 0.70 | 5.88 | Integrated | 1.5 | — | — | — | |
| | 4 | 0.80 | 2.77 | Integrated | 0.7 | — | ○ | X | |
| | 5 | 0.1 | 4.55 | Integrated | 0.35 | X | — | — | Separated, No test |
| | 6 | 2.5 | 3.57 | Integrated | 0.4 | X | — | — | Separated, No test |
| | 7 | 1.43 | 2.94 | Integrated | 0.8 | — | ○ | X | |
| | 8 | 0.67 | 4.00 | Integrated | 0.7 | — | X | ○ | |
| | 9 | 0.67 | 4.00 | Integrated | 1.1 | — | ○ | X | |
| | 10 | 0.67 | 4.00 | Each layer | 0.2 | X | — | — | Separated, No test |
| Inventive | 11 | 0.80 | 5.55 | Integrated | 1.1 | — | ○ | ○ | |
| | 12 | 0.39 | 4.00 | Integrated | 0.9 | — | ○ | ○ | |
| | 13 | 0.70 | 2.94 | Integrated | 0.6 | — | ○ | ○ | |
| | 14 | 0.15 | 4.35 | Integrated | 1.0 | — | ○ | ○ | |
| | 15 | 0.67 | 4.00 | Integrated | 1.0 | — | ○ | ○ | |
| | 16 | 1.27 | 4.00 | Integrated | 0.8 | — | ○ | ○ | |
| | 17 | 0.67 | 4.00 | Integrated | 0.9 | — | ○ | ○ | |
| | 18 | 0.67 | 4.00 | Integrated | 1.0 | — | ○ | ○ | |
| | 19 | 0.55 | 5.88 | Integrated | 0.5 | — | ○ | ○ | |
| | 20 | 0.44 | 7.69 | Integrated | 0.3 | — | ○ | ○ | |
| | 21 | 0.67 | 4.00 | Integrated | 1.0 | — | ○ | ○ | |

TABLE 3

| | No. | Diameter D (mm) | Contact layer Composition (wt %) Cr | Cu | | Thickness (mm) | High conductive layer (Cu) Cr (ppm) | Thickness $t_2$ (mm) | Taper inclination | Concentric groove Width $w_1$ (mm) | Depth $d_1$ (mm) | Diameter $D_1$ (mm) |
|---|---|---|---|---|---|---|---|---|---|---|---|---|
| Inventive | 14 | 50 | 25 | Bal | Te; | 1.5 | 3 | 10 | — | — | — | — |
| | 22 | | | | 0.05 | | | | 1/8.5 | — | — | — |
| | 23 | | | | | | | | — | 2 | 5 | 28 |
| | 24 | | | | | | | | — | — | — | — |
| | 15 | 50 | 25 | Bal | Te; | 3 | 3 | 7.5 | — | — | — | — |

TABLE 3-continued

| | | Contact layer | | | High conductive layer | | | Concentric groove | | |
|---|---|---|---|---|---|---|---|---|---|---|
| | | Composition | | | (Cu) | | | Width | | |
| | Diameter | (wt %) | | Thickness | Cr | Thickness $t_2$ | Taper | $w_1$ | Depth | Diameter |
| No. | D (mm) | Cr | Cu | (mm) | (ppm) | (mm) | inclination | (mm) | $d_1$ (mm) | $D_1$ (mm) |
| 25 | | | 0.05 | | | | 1/8.5 | — | — | — |
| 26 | | | | | | | — | 2 | 5 | 28 |
| 27 | | | | | | | — | — | — | — |

TABLE 4

| | | Side face groove | | | Temperature rise (° C.) at end of | |
|---|---|---|---|---|---|---|
| | No. | Width $W_2$ (mm) | Depth $d_2$ (mm) | Distance from contact face h (mm) | vacuum valve after 2000 A × 10 h current flow | Remarks |
| Inventive | 14 | — | — | — | 65.0 | $t_1/t_1 + t_2 = 0.13$ |
| | 22 | — | — | — | 62.5 | |
| | 23 | — | — | — | 61.0 | |
| | 24 | 1.5 | 3 | 4 | 62.5 | |
| | 15 | — | — | — | 73.5 | $t_1/t_1 + t_2 = 0.4$ |
| | 25 | — | — | — | 70.5 | |
| | 26 | — | — | — | 68.5 | |
| | 27 | 1.5 | 3 | 3 | 69.0 | |

The methods of manufacturing the electrical contacts shown in Tables 1, 2, 3 and 4 are as follows.

Cr powder having a particle size of 75 μm or less, Cu powder having a particle size of 75 μm or less and Te powder having a particle size of 60 μm or less or Nb powder having a particle size of 60 μm or less were mixed to prepare compositions shown in Tables 1 to 4, and the mixtures were mixed in a V-shape mixer to prepare a raw material for the contact layer.

A raw material for the intermediate layer was prepared in a similar manner, using the above powder. The intermediate layer is provided for alleviating strain caused by difference in shrinkage between the contact layer and the high conductive layer to prevent warp and layer separation. In order to achieve the functions, the Cr contents therein change stepwise from the contact layer to the high conductive layer. That is, in No. 19 in Table 1, only the first intermediate layer was employed, wherein the Cr content was 10 wt %, which is intermediate between the Cr content (25 wt %) in the contact layer and the Cr content (0 wt %) in the high conductive layer. In No. 20 in Table 1, the Cr content in the first intermediate layer was 15 wt % and the Cr content in the second intermediate layer was 5 wt %. The change of the Cr content in No. 20 is milder than that in No. 19.

In case Mo or W is contained, when Mo or W is contained besides Nb, Mo or W powder is mixed to prepare a raw material for the contact layer. The powder mixtures for the contact layer and intermediate layer were filled in layers in a disc form mold, and Cu powder as the powder material for the high conductive layer was filled on the above layers. The filled layers were press-molded under a pressure of 400 MPa with a hydraulic press.

Amounts to be filled in the mold were controlled so that the thicknesses of the respective layers are shown in Table 1. For comparison, regarding some of the samples, each layer was filled in the mold and press-molded. A relative density (with respect to the theoretical density) of the press-molded products was about 68 to 73%.

The molded products were sintered at 1060° C. for 2 hours in vacuum to obtain sintered products. Regarding the press-molded products wherein each of the layer powders were press-molded separately, the contact layer, the intermediate layer and the high conductive layer were stacked in the order and the stacked layers were sintered. As a result, sintered products having a density of 93 to 97% were obtained, but when the layers were stacked and sintered (No. 10 in Table 2, a stack method), layer separation took place. Therefore, the stack method was not proper, but the integral sintering was necessary to obtain sound sintered products.

Figure 1B:
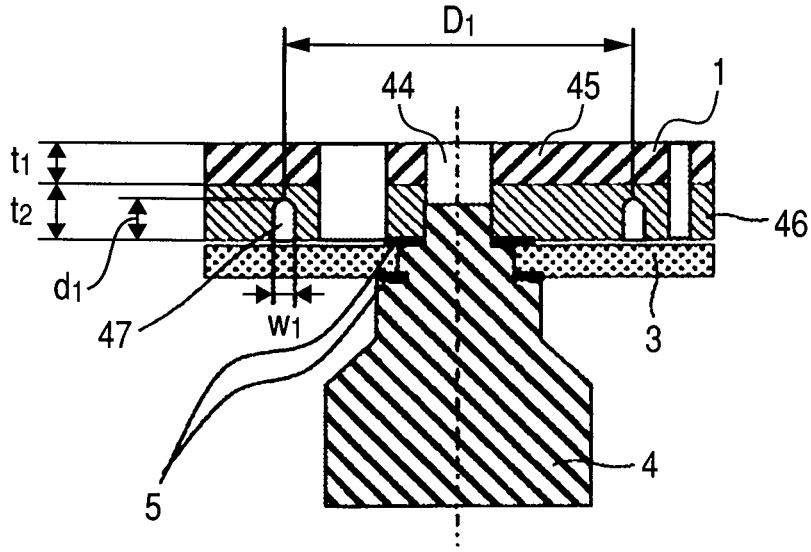
FIG. 1B shows a vertical cross sectional view of the electrode shown in FIG. 1A.
Figure 2A:
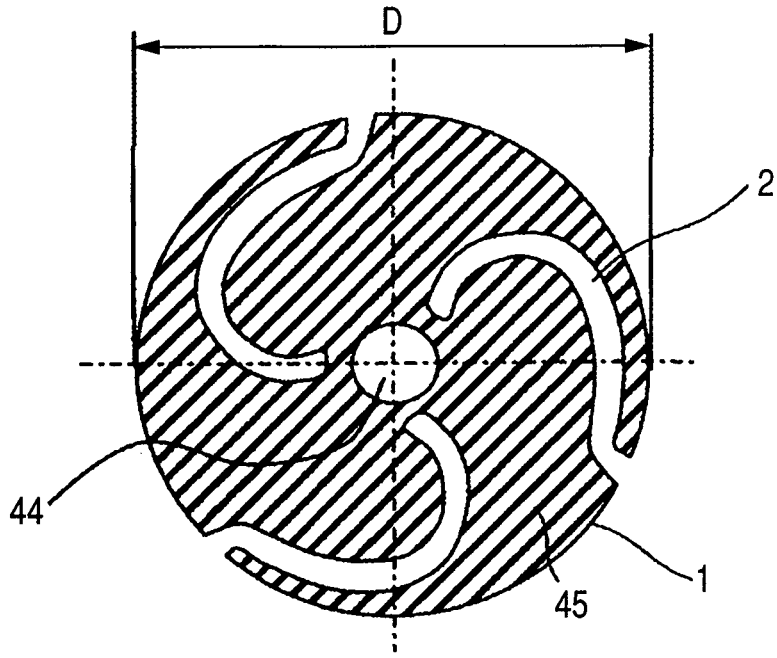
FIG. 2A shows a top plan view of a second example of an electrode having an electrical contact of the present invention.
Figure 2B:
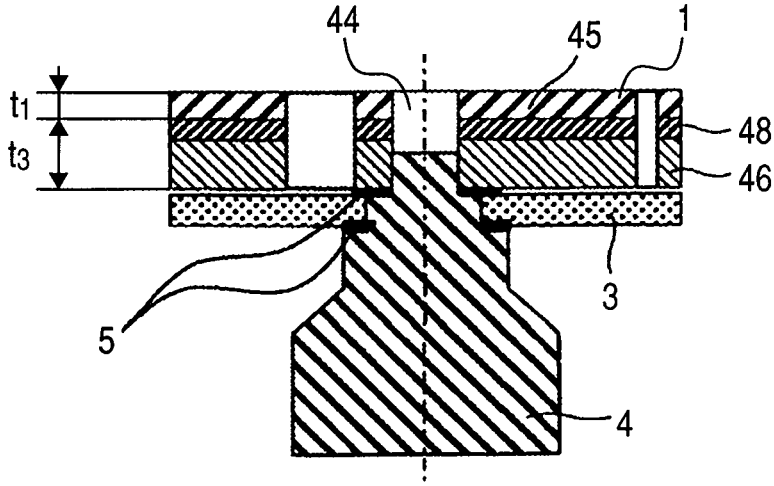
FIG. 2B shows a vertical cross sectional view of the electrode shown in FIG. 2A.

The sintered products of Nos. 5 and 6 used in the electrode shown in FIGS. 1A and 1B have dimensions outside of the ranges defined by formulae (1) and (2); the layer separation was observed in the periphery of the sintered products due to shrinkage difference in layers. In FIGS. 1A and 1B, the thickness of the contact layer was $t_1$, the thickness of the high conductive layer was $t_2$ and the diameter of the electrical contact was D.

In case of No. 3, which is outside of the ranges defined by formulae (1) and (2), the warp after sintering was remarkably large. From this result, the relationships among $t_1$, $t_2$ and D defined by (1) and (2) were essential to obtain satisfactory sintered products. In these embodiments, for comparison, electrical contact 1 was prepared by an infiltration method in the following manner. As raw materials, the Cr powder, Cu powder and Nb powder mentioned above were used. Cr powder of 55 wt %, Cu powder of 40.5 wt % and Nb powder of 4.5 wt % were mixed in the V shaped mixer and filled in the disc form mold. The powder mixture was press-molded under a pressure of 145 MPa to obtain a skeleton (low density molding).

The skeleton was placed in a graphite crucible and a copper ingot was placed on it. The skeleton and copper ingot were heated at 1200° C. for 2 hours in vacuum to infiltrate copper into the skeleton. As a result, the electrical contact of No. 1 in Tables 1 and 2 was obtained wherein the high conductive layer and contact layer were integrated.

The resulting sintered products and the infiltrated product were machined to produce the electrical contacts having the compositions and dimensions shown in FIGS. 1A to FIG. 5B and Tables 1 and 2. In order to investigate influence of warp on the interruption performance, the contact surfaces of Nos. 2 and 3 were not machined to leave the warp as it is.

The powders can be filled in a mold capable of forming a final product having slit grooves 2, followed by sintering the molding to obtain the electrical contact 1. This method eliminates machining to produce the contact easily. Then, electrodes were manufactured in the following manner. An electrode rod 4 was oxygen free copper. The stain prevention plate 3 was prepared from stainless steel (SUS304) by machining. Solder material 5 was disposed between the electrical contact 1, stain prevention plate 3 and electrode rod 4, respectively. The assembled member was heated in $8.2\times10^{-4}$ Pa or less at 970° C. for 10 minutes to produce the electrode shown in FIGS. 1A and 1B.

The electrode was used for a vacuum valve having a rated voltage of 24 kV, a rated current of 1250 A, and a rated interruption current of 25 kA. The stain prevention plate 3 plays a reinforcing plate for preventing an excess deformation of the electrical contact 1 at the time of switching operation, but if the electrical contact has a sufficient strength, it may be omitted.

Figure 6:
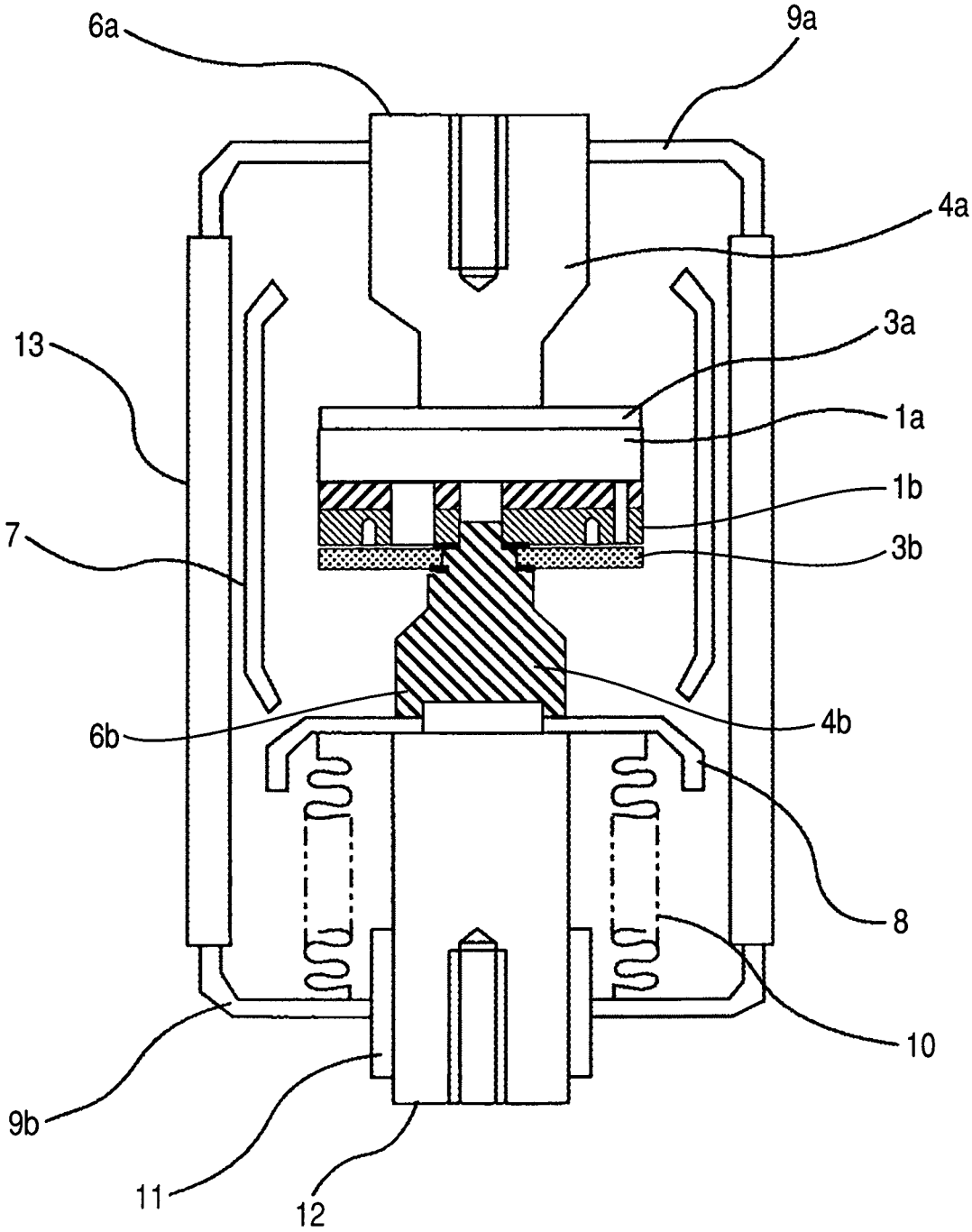
FIG. 6 shows a vacuum valve in a sixth example, which is provided with the electrode of the present invention.

Next, a vacuum valve having a rated voltage of 24 kV, a rated current of 1250 A and a rated interruption current of 25 kA was assembled. FIG. 6 shows a vacuum valve having electrical contacts 1*a*, 1*b* to which the present invention is applied. In FIG. 6, 1*a* denotes a fixed contact, 1*b* a movable contact, 3*a*, 3*b* stain prevention plates, 4*a* a fixed side electrode rod, and 4*b* a movable side electrode rod. These members constitute a fixed side electrode 6*a* and movable side electrode 6*b*.

In these examples the grooves on the fixed side and the movable side were formed so as to coincide each other. The movable electrode 6*b* was soldered to the movable side holder 12 through the movable shield 8 for preventing scattering of metal vapor at the time of interruption.

The members were soldered in high vacuum with the fixed side end plate, the movable side end plate 9*b*, and the insulating cylinder 13, and the fixed side electrode 6*a* and the movable side holder 12 are connected outside conductor with screws. The insulating cylinder 13 has a shield 7 for preventing scattering of metal vapor at the time of interruption in the inner face thereof. Further, a guide 11 for supporting a sliding part is disposed between the movable side end plate 9*b* and the movable side holder 12.

The bellows 10 is disposed between the movable side shield 8 and the movable side end plate 9*b* so that the movable holder 12 moves up and down keeping vacuum in the vacuum valve to thereby open and close the fixed electrode 6*a* and the movable electrode 6*b*. The vacuum circuit breaker with the vacuum valve mentioned above was assembled.

Figure 7:
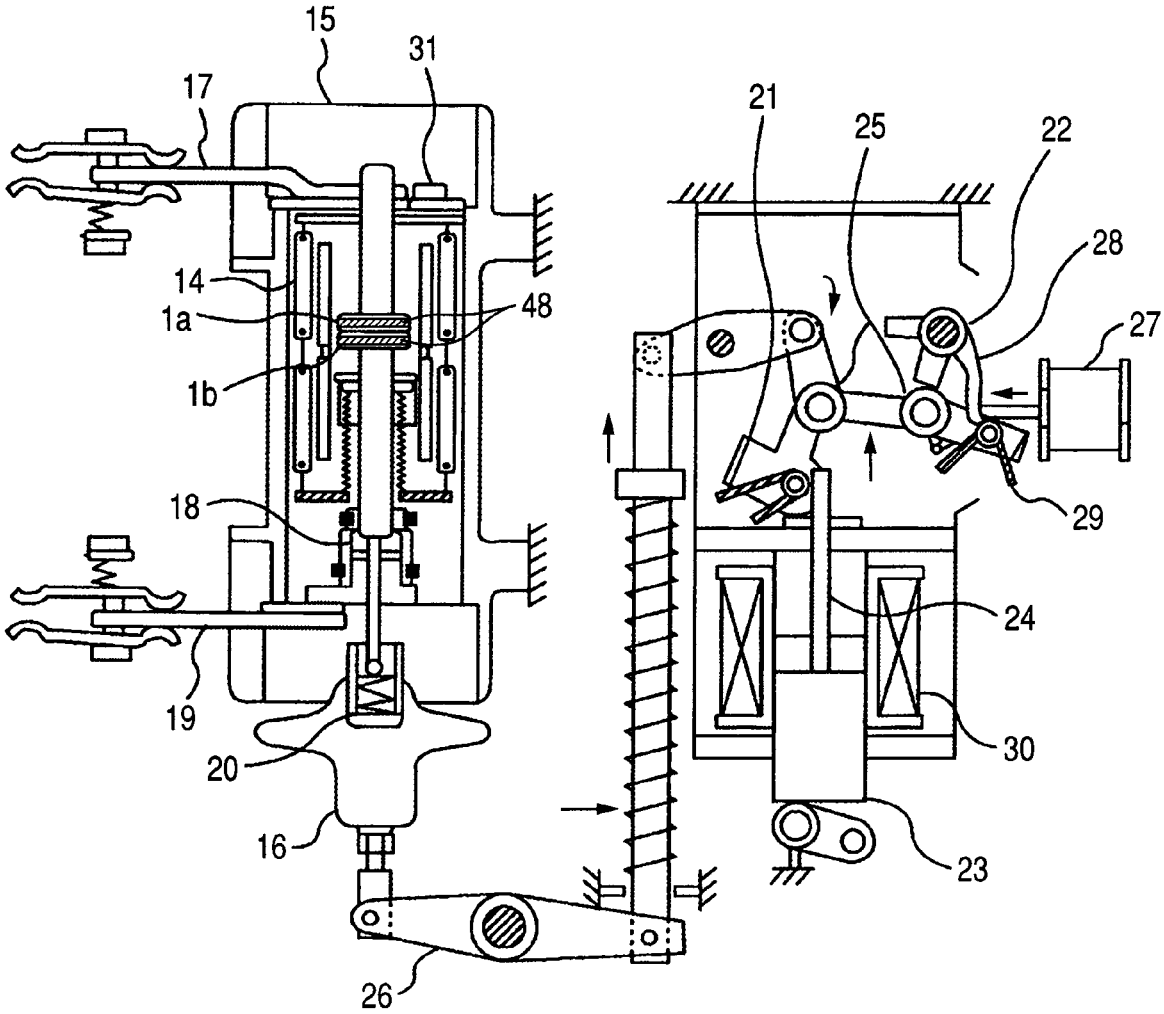
FIG. 7 shows a diagrammatic view of a vacuum circuit breaker in a seventh example to which the present invention was applied.

FIG. 7 shows a diagrammatic view of the circuit breaker having the vacuum valve with the electrical contacts to which the present invention is applied. The vacuum circuit breaker has the operating mechanism disposed at the front position, and the vacuum valve 14 is supported at the rear position. The vacuum valve has a three phase packaged epoxy resin cylinder 15. The vacuum valve 14 is operated though the insulating rod 16 by means of the operating mechanism.

When the circuit breaker is ON sate, current flows the upper terminal 17, electrical contact 1, collector 18 and lower terminal 19. A contact force between the electrodes is maintained by a spring 20 disposed to the insulating operation rod 16. The electromagnetic force by short-circuit current and contact force between the electrodes is maintained by a supporting lever 21 and a prop 22.

When the closing coil 30 is excited, the plunger 23 pushes up the knocking rod 24 from the open state to rotate the main lever 26 and close the electrodes. The supporting lever 21 maintains this state. In a state where the circuit breaker is free to trip, a trip coil 27 is excited and a trip lever 28 trips a prop 22 and rotates the main lever 26 to open the electrodes.

In case where the circuit breaker is in an open state, after the electrodes are opened, a link recovers by a reset spring 29 and the prop 22 fits. When the closing coil 30 is excited, the electrodes becomes closed.31 denotes an evacuate cylinder. As having explained above, the circuit breaker of the rated voltage of 24 kV, the rated current of 1250 A and the rated interruption current of 25 kA was assembled using the vacuum valve 14 having the electrical contacts 1.

(Evaluation)

Regarding the electrical contacts shown in Tables 1 and 2, the contacts disposed in the vacuum circuit breaker were investigation by interruption of 25 kA and separation of electrodes after 25 kA current flow.

In Tables 1 and 2 showing compositions of the electrical contacts, dimensions, molding methods and interruption test results, Nos. 1-10 are comparative, and Nos. 11-21 are inventive. In the molding method in Table 1, "each layer" means that each of the contact layer, intermediate layer and high conductive layer are separately molded and they were laminated or stacked. "Integrated" means that the three or more layers are integrated by stacking the powder layers and molded.

The warp size in Table 2 is represented by a difference between the periphery and the center portion when the sintered products are placed in such a manner that the high conductive layer is at bottom. Among the electrical contacts, layer separation was observed in Nos. 5, 6, and 10, and therefore, they were not subjected to interruption test.

The electrical contacts produced by infiltration method did not have any problems such as warp or separation and they satisfy current interruption properties, but separation was impossible after the current flow. Since Cr, which is a contact material, dissolves into Cu of the high conductive layer during infiltration to lower heat and current conductivity of the high conductive layer, the effect of the high conductive layer for suppressing joule heat is insufficient.

No. 2 is an electrical contact constituted only by the component of the contact layer. In this case, since the high conductive layer is absent, conductivity of the whole electrical contact is relatively low, interruption property is insufficient, and the contacts welded by increase in temperature due to joule heat and separation thereof was impossible. Nos. 3 and 4 have high conductivity, but the dimension relationships (diameter D of the contact and thickness $t_1$ and $t_2$) thereof are outside of the ranges defined by formula (2). No. 3 had a large warp after sintering, and it was not subjected to testing. No. 4 had a warp within an allowable range, but a thickness of the contact layer is too large so that conductivity was low and welding occurred. Welding was not separated.

No. 7, similar to Nos. 5 and 6, which brought about layer separation, had relationships outside range defined by formula (1). In this case, although the warp after sintering is within an allowable range, the thickness of the contact layer was too large and the conductivity of the contact layer was low and welding occurred. On the other hand, Nos. 11 to 16, whose relationships of thicknesses of respective layers ($t_1$, $t_2$) and diameter D of the contact are within the range defined by formulae (1) and (2), interruption propertied and separation after the current flow were satisfied. Accordingly, it was confirmed that the electrical contacts according to the present invention were particularly useful as contacts having excellent interruption characteristics and anti-welding property.

It has been confirmed that in order to suppress the warp within an allowable range, to avoid welding by contact resistance joule heat, and to produce electrical contacts that satisfy required characteristics, the relationships defined by formulae (1) and (2) are desired. Nos. 19 and 20, which have intermediate layers, are not limited to the above results. That is, in case the intermediate layer is formed, the relationships among the diameter D and thickness of each layer ($t_1$, $t_3$) should be within the ranges defined by formulae (3) and (4). As shown in Table 2, the warp and welding were suppressed and sufficient interruption characteristics were obtained. On the other hand, Nos. 8 and 9 have compositions of Cr outside of 15 to 30 wt %. Since No. 8 is short Cr for the arc resistive metal, voltage withstanding was insufficient and interruption property was not satisfactory. No. 9, which is excessive for Cr, conductivity of the contact layer was low and temperature rise due to joule heat was large, and welding occurred because of the warp.

The sample Nos. 17 and 18 of which Cr amounts are within the range mentioned above exhibited satisfactory performance. No. 21, which has the contact layer containing Nb of 3 wt % as same as No. 1 produced by infiltration, was produced by sintering, and solid solution of Cr into Cu phase was small and hence it had high conductivity. As a result, the joule heat was suppressed to exhibit necessary performance.

As having been discussed, the present invention provides electrical contacts, vacuum valve and vacuum circuit breaker with excellent interruption permeance and anti-welding property.

Example 7

Application to Vacuum Circuit Breakers

Using the vacuum circuit breaker assembled in the above embodiment that has the electrical contacts shown in Tables 3 and 4, current flow tests were conducted to evaluate warp during the current flow.

In this investigation, the electrical contacts No. 14 and No. 15 were employed. The electrodes shown in FIGS. 1A to 5B were prepared and warp suppression effect of the concentric groove 47, the side face groove 49 and the taper 50 were investigated at the time of the turning on.

The grooves and taper were formed by machining. Since an amount of warp during the current flow, a temperature rise at an end of the vacuum valve after the current flow of 2000 A for 10 hours was measured to evaluate the amount of warp. Measurement of temperature rise was conducted at 24° C. The results are shown in Table 4.

Figure 3A:
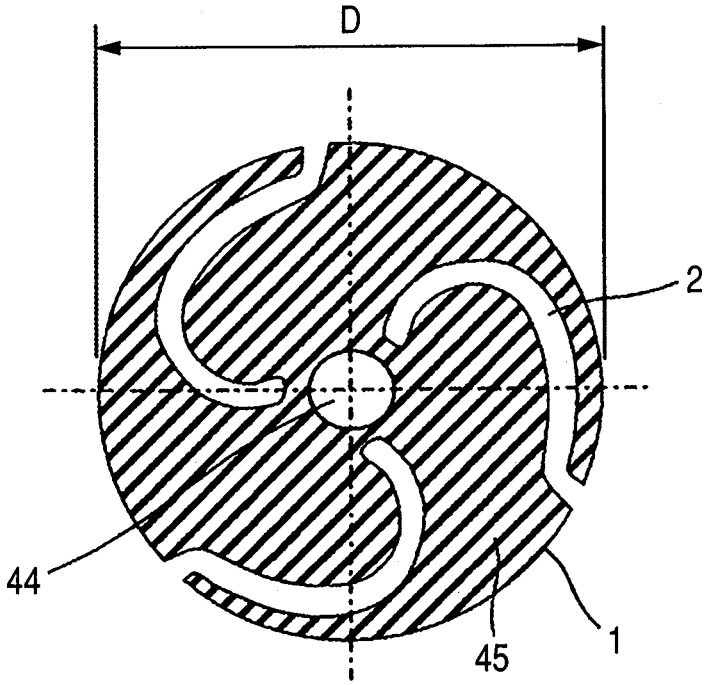
FIG. 3A shows a top plan view of a third example of an electrode having an electrical contact of the present invention.
Figure 3B:
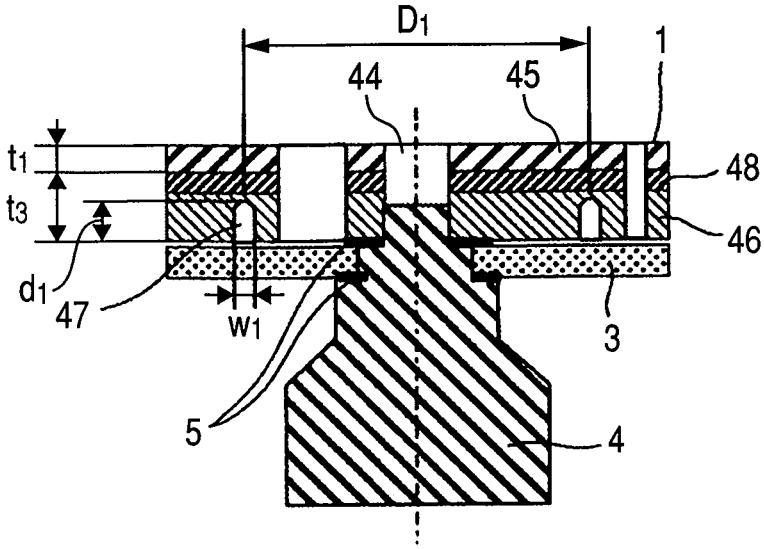
FIG. 3B shows a vertical cross sectional view of the electrode shown in FIG. 3A.
Figure 4A:
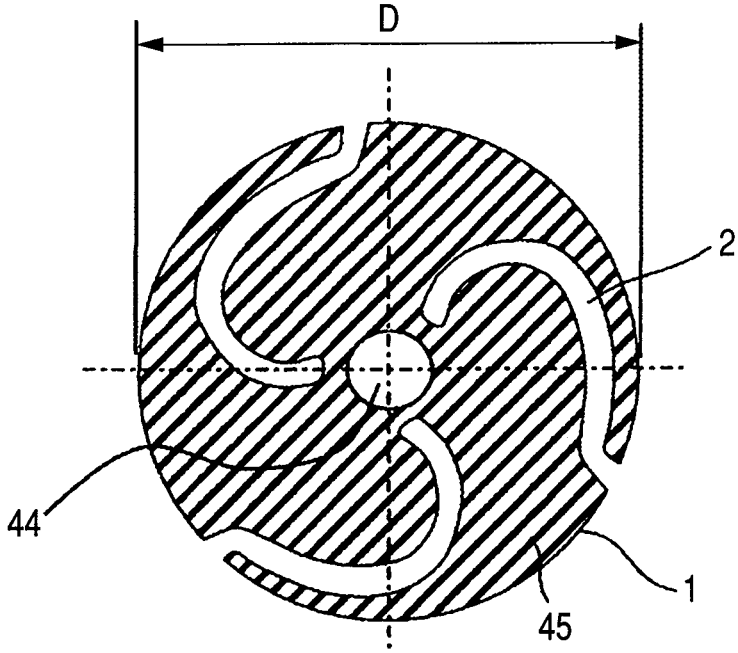
FIG. 4A shows a top plan view of a fourth example of an electrode having an electrical contact of the present invention.
Figure 4B:
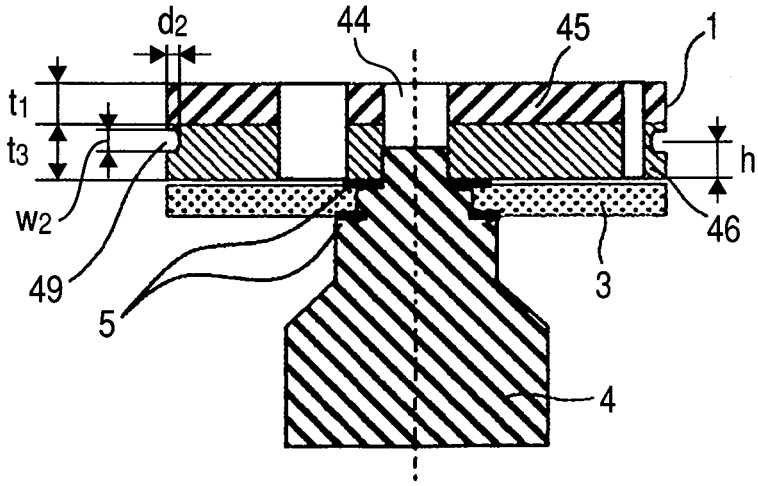
FIG. 4B shows a vertical cross sectional view of the electrode shown in FIG. 4A.
Figure 5A:
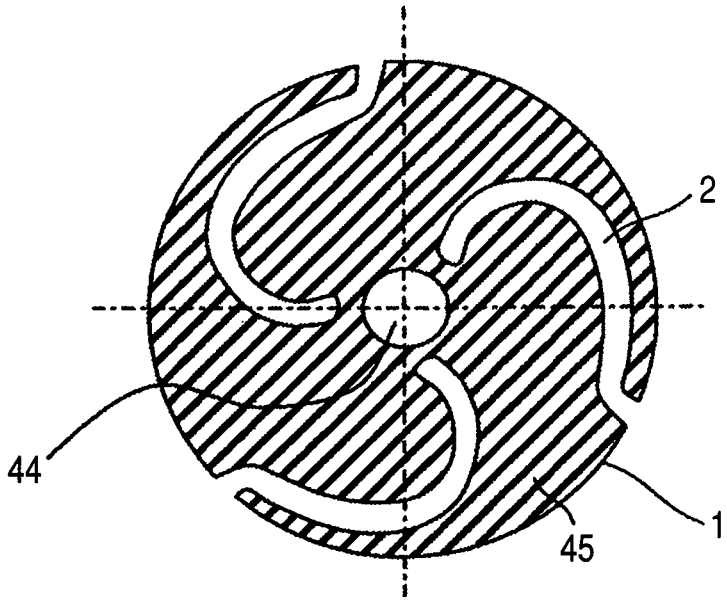
FIG. 5A shows a top plan view of a fifth example of an electrode having an electrical contact of the present invention.
Figure 5B:
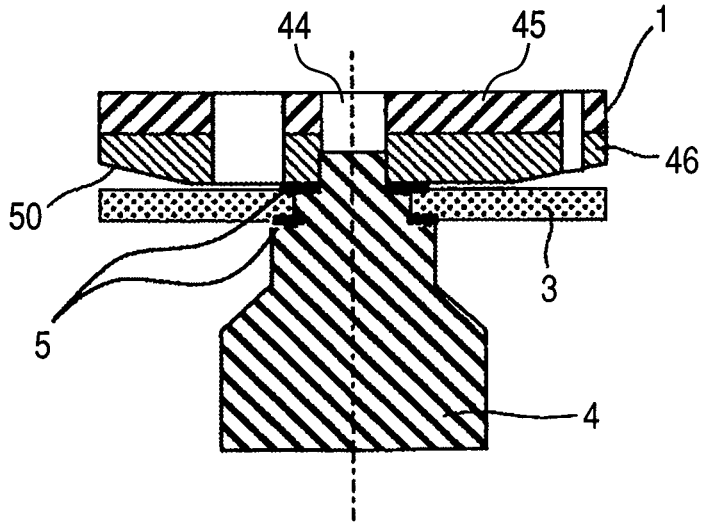
FIG. 5B shows a vertical cross sectional view of the electrode shown in FIG. 5A.

In Tables 3 and 4, No. 14 and No. 15 are the electrical contacts shown in Tables 1 and 2, No. 22 and No. 25 are electrical contacts shown in FIGS. 5A and 5B. No. 23 and No. 26 are electrical contacts having the concentric groove 47 in the high conductive layer, which are shown in FIGS. 3A and 3B. No. 24 and No. 27 have side face grooves 49 shown in FIGS. 4A and 4B. These contacts have no intermediate layers.

As shown in Table 4, the contacts having any of the taper 50, the concentric groove 47 and the side face groove 49 exhibited a temperature rise smaller than the case where taper, etc was not formed. Accordingly, it is presumed that the taper, etc should suppress the warp.

Since the effect of temperature rise suppression by the taper, etc in Nos. 25 to 27 is larger than that in Nos. 22 to 24, it is considered that if the thickness of the contact layer to the total thickness of the contact is sufficiently large, the suppression effect is large.

As has been discussed, the contour of the electrical contacts of the present invention plays a very important role to suppress the warp during the current flow, which leads to excellent anti-welding property.

Example 8

Application to Vacuum Switchgears

Figure 8:
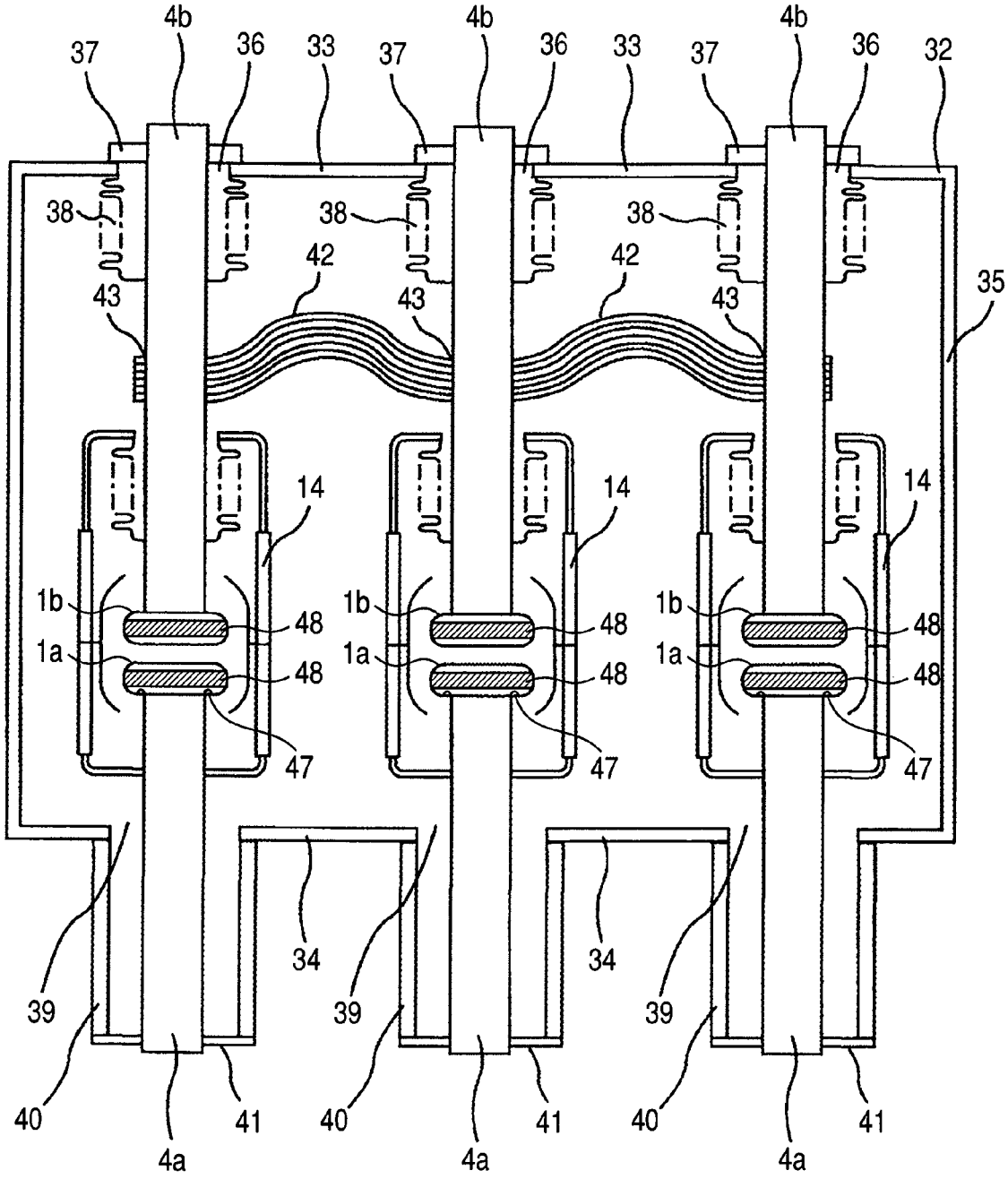
FIG. 8 shows a vacuum switchgear in an eighth example to which the present invention was applied.

A vacuum switchgear was assembled using the vacuum valves assembled in the examples described above. FIG. 8 shows a diagrammatic cross sectional view of the vacuum switchgear for load switchgear for transformers, which is installed on road shoulder as a substation.

The load switchgear has a plurality of the vacuum valves 14 that correspond to the main switch section in an outer vacuum vessel 32. The outer vacuum vessel 32 is composed of an upper plate 33, lower plate 34 and side plate 35, and edges of the plates are welded.

An upper through holes 36 are formed in the upper plate 33 and insulating upper bases 37 are fixed at the peripheries of the though holes 36 to cover the upper through holes. Movable side electrode rods 4*b* are inserted into the circular space formed at the center of the upper bases 37 in such a manner that the electrode rods move reciprocately up and down.

Each of the upper bases and each of the movable side electrode rods 4*b* seal each of the upper through holes 36.

An axial end (upper side) of the movable electrode rod 4*b* is connectable to an operating mechanism (electromagnetic operator), which is disposed outside the outer vacuum vessel 32. An outer bellows 38 is dispose along the edge of the each upper through hole 36 at the bottom end of the upper plate 33. Each outer bellows 38 is fixed at its one end in the axial direction and the other end is fixed to the outer periphery of each movable electrode rod 4*b*.

In order to make the outer vacuum vessel 32 vacuum tight structure, the outer bellows 38 are disposed at the periphery of each through hole 36 along the axial direction of each movable electrode rod 4*b*. The upper plate 33 has a evacuate port (not shown), and the vacuum vessel is evacuated through the evacuate port.

On the other hand, a lower through holes 39 are formed in the lower plate 34, and insulating bushings 40 are disposed to the peripheries of the lower through holes 39 to seal each lower through hole 39. A circular insulating lower base 41 is fixed to the bottom of each insulating bushing 40. A columnar fixed side electrode rod 4*a* is inserted into the central space of each lower base 41.

The lower through holes 39 formed in the lower plate 34 are sealed by the insulating bushings 40, the lower bases 41, and the fixed side electrode rods 4*a*. One end of the fixed side electrode rod 4*a* in axial direction (lower side) is connected to a cable (distributing wire) disposed outside the outer vacuum vessel 32.

The vacuum valves 14 corresponding to the main switches of the load switches are accommodated in the outer vacuum vessel 32, and each movable electrode rod 4*b* is electrically connected to other movable electrode rods by means of a flexible conductor 42, which has two curved portions. The flexible conductor 42 is formed by laminating alternately copper plates and stainless steel plates, wherein the copper plates and stainless steel plates have curved portions in their length direction. The flexible conductor 42 has through holes 43 through which the movable electrode rods 4*b* are inserted to connect each other.

The vacuum valves prepared in the examples can be used for various vacuum switchgears such as the load switches installed on road shoulders.

What is claimed is:

1. An electrical contact comprising:

a contact layer for making contact with an opposing electrical contact; and a high conductive layer in an opposite side of the contact layer, wherein the contact layer and the high conductive layer are integrally connected to each other, and the contact layer and the high conductive layer have a disc form, wherein the contact layer contains Cr, Cu and Te, and the high conductive layer contains copper as a main component, wherein the high conductive layer is provided with a means for suppressing warping of the contact layer at the time of turning on the contacts, and wherein the means for suppressing warping includes one or more of: at least one concentric groove, formed in the high conductive layer, with respect to the contact layer; at least one side face groove formed in the side face of the high conductive layer; an intermediate layer, sandwiched between the high conductive layer and the contact layer, having a composition intermediate between that of the contact layer and that of the high conductive layer; and a taper, formed in a rear face of the high conductive layer opposite to the contact layer, inclined towards the periphery of the high conductive layer such that the periphery is thinner than an inner region thereof.

2. The electrical contact according to claim 1, wherein the means for suppressing warping is the concentric groove, and wherein provided that a thickness of the contact layer is $t_1$, a thickness of the high conductive layer is $t_2$, and a diameter of the electric contact is D, there are following relationships among $t_1$, $t_2$ and D, the high conductive layer having at least one groove concentric with the electrical contact in a face opposite to the contact face of the electrical contact $$0.15t_2 \leqq t_1 \leqq 1.27t_2 \quad (1)$$

$$2.94(t_1+t_2) \leqq D \leqq 5.55(t_1+t_2) \quad (2).$$

3. The electrical contact according to claim 2, wherein the means for suppressing warping is the intermediate layer and wherein provided that a thickness of the contact layer is $t_1$, a total thickness of the high conductive layer and the intermediate layer is $t_3$, and a diameter of the electric contact is D, there are following relationships among $t_1$, $t_3$ and D $$0.15t_3 \leqq t_1 \leqq 0.80t_3 \quad (3)$$

$$2.94(t_1+t_3) \leqq D \leqq 8.10(t_1+t_3) \quad (4).$$

4. An electrical contact comprising:

a plurality of layers including a contact layer, a high conductive layer, and an intermediate layer between the contact layer and the high conductive layer, wherein the layers are integrally connected to each other, and the intermediate layer has an intermediate composition of the contact layer and the high conductive layer, wherein the contact layer consists essentially of Cr, Cu and Te, and the high conductive layer consists essentially of copper, and wherein provided that a thickness of the contact layer is $t_t$, a total thickness of the high conductive layer and the intermediate layer is $t_3$, and a diameter of the electric contact is D, there are following relationships among $t_1$, $t_3$ and D:

$$0.15t_3 \leqq t_1 \leqq 0.80t_3 \quad (3)$$

$$2.94(t_1+t_3) \leqq D \leqq 8.10(t_1+t_3) \quad (4).$$

5. The electrical contact according to claim 4, wherein the high conductive layer and the intermediate layer have at least one groove in a concentric circle with the electrical contact.

6. The electrical contact according to claim 4, wherein the high conductive layer has a tapered shape whose thickness decreases towards the periphery thereof, an inclination of the tapered shape being ½ to 1/30 of the thickness of the high conductive layer.

7. The electrical contact according to claim 4, wherein the groove formed in a face opposite to a contact face has a width of $w_1$, a depth of $d_1$, a diameter of $D_1$, a total thickness of the high conductive layer and the intermediate layer of $t_3$, and a diameter of the electrical contact of D, and there are following relationships among D, $w_1$, $t_3$, $d_1$ and $D_1$:

$$0.015D \leqq_{w1} \leqq 0.045D \quad (5)$$

$$0.08t_3 \leqq d_1 \leqq 0.95t_3 \quad (6)$$

$$0.35D \leqq D_1 \leqq 0.85D \quad (7).$$

8. The electrical contact according to claim 4, wherein the high conductive layer or the intermediate layer has a side face groove in its side face, and the side face groove has a width of $w_2$, a depth of $d_2$, a distance h between a face opposite to a contact face, a total thickness $t_3$ of the high conductive layer and the intermediate layer, and a diameter D of the electrical contact, and there are following relationships among $t_3$, $w_2$, D and h:

$$0.025t_3 \leqq w_2 \leqq 0.5t_3 \quad (8)$$

$$0.003D \leqq d_{2\leqq} 0.085D \quad (9)$$

$$0.1t_3 \leqq h \leqq 0.9t_3 \quad (10).$$

9. The electrical contact according to claim 4, wherein the high conductive layer has a tapered shape at a face opposite to a contact face, an angle of the tapered face being ½ to 1/30 of the thickness of the high conductive layer.

10. The electrical contact according to claim 4, wherein the contact layer consists essentially of 15 to 30 wt % of Cr, 0.01 to 0.2 wt % of Te, the balance being Cu.

11. The electrical contact according to claim 4, wherein the contact layer contains at least one member selected from the group consisting of Mo, W and Nb in an amount of 30 wt % in the total of Cr and the member.

12. The electrical contact according to claim 4, wherein the contact layer has a center hole formed at a center thereof and a plurality of slits are disposed from the center towards a periphery thereof, where the slits are not in contact with the center hole, whereby the disc form includes a plurality of wings.

13. The electrical contact according to claim 4, wherein an amount of solid solution of Cr in the Cu constituting the high conductive layer is 10 ppm or less.

14. The electrical contact according to claim 4, wherein the high conductive layer includes means for suppressing warping including one or more of: at least one side face groove formed in the side face of the high conductive layer; and a taper, formed in a rear face of the high conductive layer opposite to the contact layer, inclined towards the periphery of the high conductive layer such that the periphery is thinner than an inner region thereof.

15. The electrical contact according to claim 4, wherein the high conductive layer includes including one or more of: at least one side face groove formed in the side face of the high conductive layer; and a taper, formed in a rear face of the high conductive layer opposite to the contact layer, inclined towards the periphery of the high conductive layer such that the periphery is thinner than an inner region thereof.

16. The electrical contact according to claim 4, wherein the high conductive layer includes a taper, formed in a rear face of the high conductive layer opposite to the contact layer, inclined towards the periphery of the high conductive layer such that the periphery is thinner than an inner region thereof.

17. An electrode comprising the electrical contact according to claim 4 and an electrode rod bonded to a disc of the high conductive layer of the electrical contact.

18. A vacuum valve comprising a pair of a fixed electrode and a movable electrode in a vacuum chamber, wherein at least one of the electrodes has the electrical contact according to claim 17.

19. A vacuum circuit breaker comprising a vacuum valve according to claim 18, the vacuum valve being provided with at least the comprising the fixed electrode and the movable electrode which are connected to conductor terminals extending outside of the vacuum chamber, and an operating mechanism for driving the movable electrode.

20. A vacuum circuit breaker comprising a vacuum valve according to claim 18, the vacuum valve being provided with at least the pair of the fixed electrode and the movable electrode which are connected to conductor terminals extending outside of the vacuum chamber, and an operating mechanism for driving the movable electrode.

* * * * *